US005129708A

United States Patent [19]

Swan

[11] Patent Number: 5,129,708

[45] Date of Patent: Jul. 14, 1992

[54] WOODEN FLOOR STRIPPING MACHINE

[75] Inventor: Leo Swan, Jefferson, Md.

[73] Assignee: Equipment Development Company, Inc., Frederick, Md.

[21] Appl. No.: 760,002

[22] Filed: Sep. 13, 1991

[51] Int. Cl.[5] ..... B24B 23/02; F21C 25/16

[52] U.S. Cl. ..... 299/41; 51/177

[58] Field of Search ..... 299/37, 41; 51/170 T, 51/174, 177; 30/170

[56] References Cited

U.S. PATENT DOCUMENTS

| | | | |
|---|---|---|---|
| 2,624,896 | 1/1953 | Atkin | 51/177 X |
| 3,102,372 | 9/2963 | Vezner | 299/41 X |
| 4,398,737 | 8/1983 | Harding | 51/177 X |
| 4,614,380 | 9/1986 | Allen | 299/41 |
| 4,668,017 | 5/1987 | Peterson et al. | 299/37 |
| 4,758,050 | 7/1988 | Peterson et al. | 299/39 |

*Primary Examiner*—David J. Bagnell
*Attorney, Agent, or Firm*—Birch, Stewart, Kolasch & Birch

[57] ABSTRACT

A manually pushed stripping machine which includes a wheeled undercarriage, an upper cutter head assembly pivotally mounted at the rear of the undercarriage and a rearwardly extending handle secured to the upper assembly. The undercarriage additionally includes a manually adjustable bolt located at the front for selectively varying the height of a pair of cutter heads having a plurality of cutting fingers attached thereto. Additionally, a cutter head angle adjustment fixture is located on the rear portion of the undercarriage. A handle latch member having a forward end pivotally connected to the undercarriage includes an angulated slot which engages and outwardly projecting bolt located on the upper assembly so that when the handle is lowered to a horizontal position, the bolt engages and locks the rear portion of the angulated slot to prevent a further pivoting of the upper assembly on the undercarriage. This results in the cutter heads being tilted up for easy maintenance or, alternatively, the entire machine can thereafter be lifted by the handle and wheeled about without the cutter heads touching the floor.

22 Claims, 3 Drawing Sheets

WOODEN FLOOR STRIPPING MACHINE

BACKGROUND OF THE INVENTION

This invention relates generally to cutting machines and more particularly to a stripping machine employing one or more cutting heads for removing residual material such as mastic or glue left over from carpets previously laid on wooden floors to facilitate cleaning a floor during a refinishing process or further application of additional or new carpet.

Various techniques and forms of machines and devices have been developed for removing residual material from floors. Examples include the removal of coating such as urethane and elastomeric coatings from concrete surfaces and mastics or other types of adhesives used during the application of floor coverings on wooden floors. Among the techniques and devices for removing such materials are simple scraping tools, heat or chemical removing devices as well as sanding or grinding machines which cut or grind away the undesired coating. One known type of stripping machine utilized for removing residual material and includes a pair of cutter head assemblies comprises the machine shown and described in U.S. Pat. No. 4,668,017, entitled, "Stripping Machine", issued to Clayton R. Peterson et al on May 26, 1987. It further comprises a motor driven piece of equipment which is adapted to be ridden during a stripping operation.

SUMMARY

Accordingly, it is the principal object of the present invention to provide an improvement in cutting machines.

Another object of this invention is to provide a relatively small and more portable stripping machine which can be utilized for the removal of residual material from the surface of a floor during a refinishing process.

It is a further object of the invention to provide a stripping machine which enables the entire stripper head assembly to be adjusted in vertical height with respect to the floor surface.

It is yet another object of the invention to provide a stripper machine wherein the stripper head assembly can also be adjustably tilted forward so as to provide a more aggressive cutting angle during the removal of residual material from a floor surface.

It is yet a further object of the invention to provide a stripper machine which permits an easy access to the stripper head assembly during maintenance and can also be easily rolled from place to place with the cutter head assembly tilted backwards so that it will not engage the floor surface.

These and other objects are realized by a stripping machine including: (a) a wheeled undercarriage for movement across a floor to be refinished and having cutter height adjustment means located at the front thereof and cutter angle adjustment means located at the rear thereof, with the height adjustment means being comprised of a vertically adjustable support element and the cutter angle adjustment means being comprised of means projecting rearwardly from the carriage for selectively raising the lowering the back end of the undercarriage and accordingly the forward angle of attack of a cutter head; (b) an upper assembly pivotally mounted at the rear of the undercarriage and having a forward projecting cutter head support and a motor mount located behind the cutter head support, the support further having a front portion resting on the vertically adjustable support element of the cutter height adjustment means, permitting the height of the cutter head above the floor to be controlled; (c) a handle secured to the upper assembly; (d) at least one cutter head, including a plurality of downwardly projecting floor stripping cutter elements, rotatably mounted on the cutter head support; (e) a drive motor for powering the cutter head(s) located on the motor mount; and (f) an elongated handle latch member having a forward end pivotally connected to the undercarriage and including an angulated slot engaging an outwardly projecting member located on the motor mount whereby when the handle is lowered to a horizontal position, the outwardly projecting member engages a rear portion of the angulated slot to prevent further pivoting of the upper assembly whereby the cutter head is tilted up for easy maintenance or the entire machine can thereafter be lifted and wheeled across the floor without the cutter head touching the floor.

BRIEF DESCRIPTION OF THE DRAWINGS

The following detailed description of the invention will be more readily understood when considered together with the accompanying drawings wherein.

DETAILED DESCRIPTION OF THE INVENTION

Figure 1:
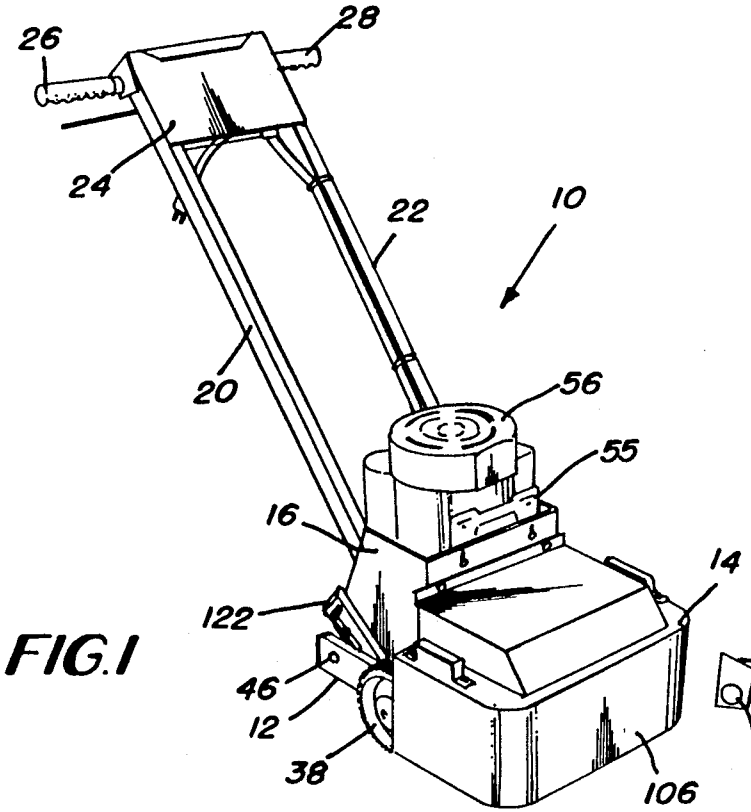
FIG. 1 is a perspective view generally illustrative of the preferred embodiment of the invention.

Referring now to the drawings wherein like reference numerals refer to like parts throughout, reference numeral 10 in FIG. 1, for example, denotes a stripping machine in accordance with the invention and one comprised of, among other things, a wheeled undercarriage 12 upon which is mounted a unitary assembly consisting of a gear case 14 and motor mount bracket 16 to which is attached an elongated handle 18 including two elongated handle members 20 and 22 which terminate at the upper end in a motor control box 24 and a pair of handle bars 26 and 28.

Figure 2A:
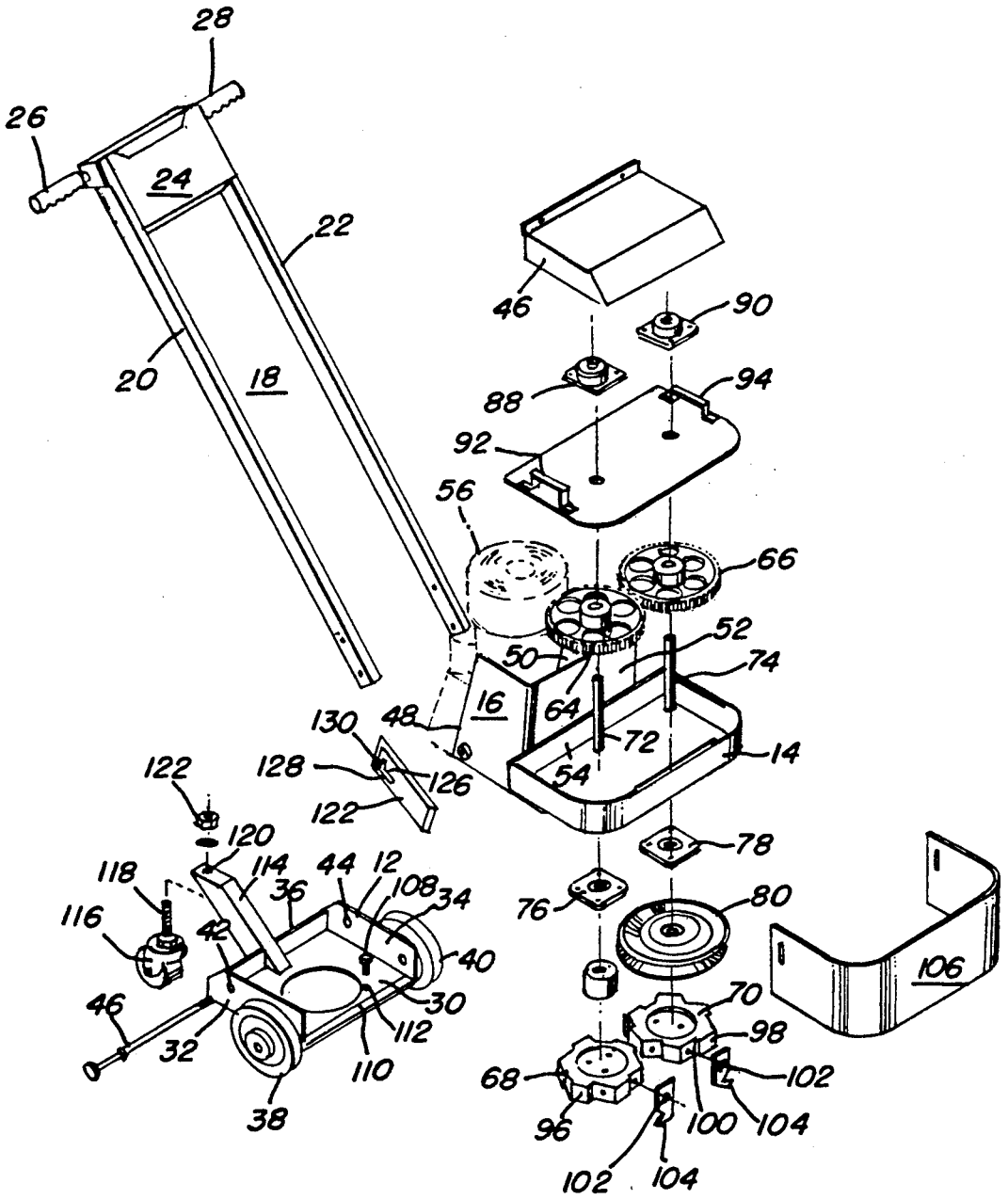
FIGS. 2A and 2B are exploded views illustrating the various parts of the embodiment shown in FIG. 1.

The undercarriage 12, as shown in FIG. 2A, consists of a generally rectangular pan type structure having a bottom wall 30, a pair of opposing side walls 32 and 34, and a relatively narrow back wall member 36. A pair of wheels 38 and 40 are mounted on the carriage at the forward end of the side walls 32 and 34 and are used to manually move the stripping machine 10 not only in use during a stripping operation, but also during transport.

Figure 2B:
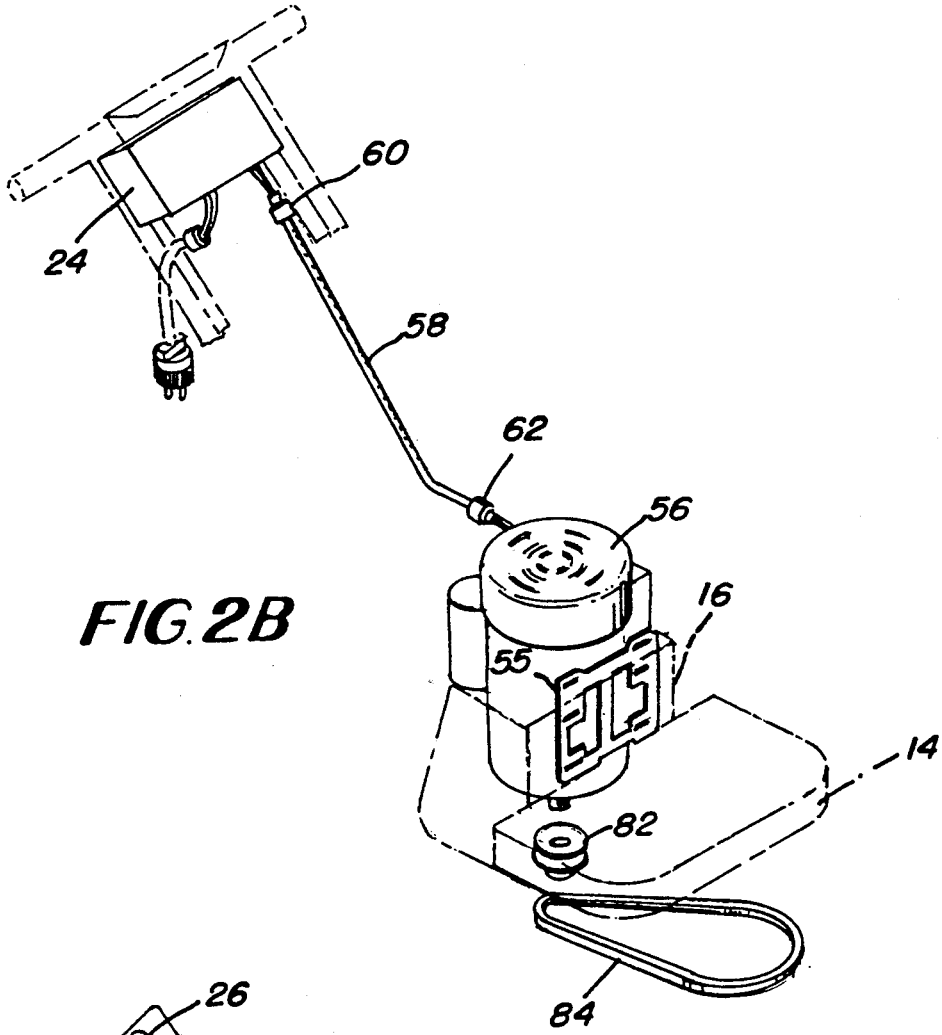

To the rear of the side walls 32 and 34 are a pair of mounting holes 42 and 44 through which there is adapted to pass an elongated threaded rod or bolt 46 which operates as a pivot or axle for both the gear case 14, the motor mount bracket 16 and the elongated handle 18. In this regard, the two handle members 20 and 22 are secured to the bracket side walls 48 and 50, with the front wall 52 thereof being attached to the rear wall 54 of the gear case 14 by means of a mounting plate 55. An electric motor 56 is adapted to be mounted on the bracket 16 behind the front wall 52 and between the side walls 48 and 50. An electric power cable 58 including a pair of intermediate connectors 60 and 62 extend from the motor 56 to the control box 24 as shown in FIG. 2B. The connectors 60 and 62 permit an easy disconnection and reconnection to the machine when the handle 18 is removed.

The gear tray 14 comprises a housing for a pair of equal sized gears 64 and 66 which are intermeshed and connected to a pair of cutter heads 68 and 70 by means of a pair of spindles 72 and 74 which pass through a pair of journal bearings 76 and 78 located on the underside of the gear case 14. Also connected to one of the spindles 74 is a relatively large diameter sheave or pulley 80 which is coupled back to the motor 56 by a relatively small diameter sheave or pulley 82 (FIG. 2B) and a drive belt 84. Thus the motor 56 drives the cutter heads 68 and 70, which rotate in mutually opposite directions via the meshed gears 64 and 66.

Further as shown in FIG. 2A, on top of the gear case 14 is a cover member 86 which is also adapted to accommodate an upper pair of journal bearings 88 and 90. To the sides of the cover 86 are a pair of handles 92 and 94 which facilitate lifting of the entire assembly from the undercarriage 12. A hood 96 is further shown covering the journal bearings 88 and 90.

With respect to the cutter heads 68 and 70, they comprise a subassembly including a plurality of peripheral faces 98 in which there are formed an equal number of vertical slots 100 in which there are mounted a respective number of vertically depending cutter fingers 102 having cutter elements at their lower extremity. With the cutter heads 68 and 70 in position, a protective skirt 106 wraps around the front of the gear case 14 in order to provide a protective shield both for and against the cutter heads 68 and 70 when in use.

It is to be particularly noted that the undercarriage 12 additionally includes two elements, one of which permits control of the height of the cutter heads 68 and 70 off of the surface of the floor being refinished and the other comprising a means for varying the angle of attack or tilt of the cutter heads 68 and 70 with respect to the floor surface. The height adjustment means consists of a manually adjustable threaded bolt, or the like, 108 located in a threaded bore 110 and a fixed nut 112 located in a forward portion of the bottom wall 30 of the carriage 12. Angle of attack adjustment resides in a subassembly located at the rear of the carriage 12 and comprises an upwardly angulating bar member 114 secured to the back wall 36 and a swivel caster element 116 having a threaded shank 118. The threaded shank 118 is adapted to project upwardly through a threaded bore 120 where it engage a lock nut or the like 121. By manually adjusting the length of the shank 118 in the threaded bore 120, the angle of tilt of the carriage 12 is varied. This positional change is transferred to the gear case 14 and the cutter heads 68 and 70.

Although the upper assembly including the gear case 14 and motor mount bracket 16 are adapted to pivot about the axle 46 by movement of the handle 18, this motion can be inhibited during a maintenance or repair procedure or during transport of the stripping machine, by a slotted latch bar member 122 located between the motor mount bracket side wall 16 and the side wall 32 of the undercarriage 12. The latch bar 122 is mounted behind the right front wheel 38 by a pivot element 124. The rear portion of the latch bar 122 includes a right angled slot 126 which includes a relatively longer horizontal slot portion 128 and a relatively shorter vertical slot portion 130. The slot 126 engages an outwardly projecting element 132 which is affixed to the side wall 48 of the motor mount bracket 16.

Figure 3:
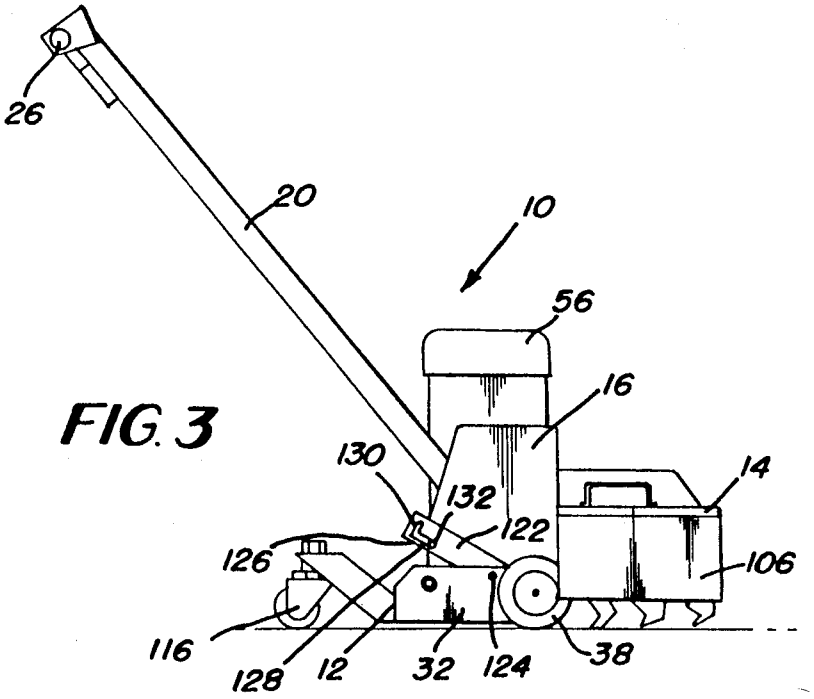
FIG. 3 is a side planar view illustrative of the embodiment shown in FIG. 1 in its normal use position.
Figure 4:
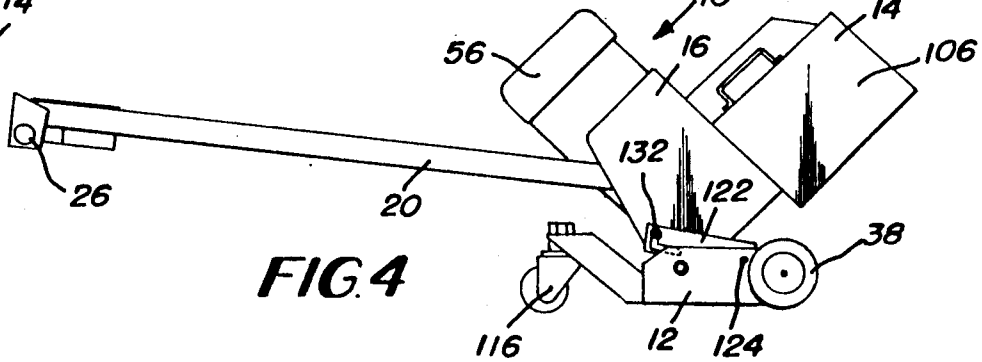
FIG. 4 is a side planar view of the embodiment shown in FIG. 1 in a handle lock-down position.
Figure 5:
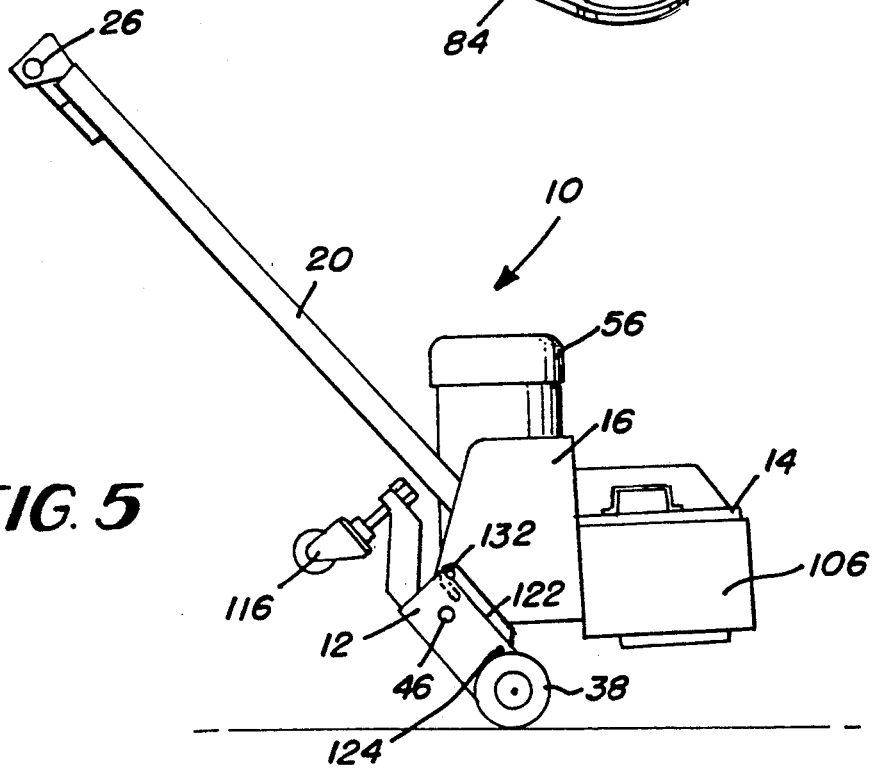
FIG. 5 is a side planar view illustrative of the transport position of the embodiment shown in FIG. 1.

In normal use, the member 132 slides along the horizontal slot portion 128 as shown in FIG. 3, depending upon the angle of the handle 18 relative to the floor. When it is desirable to inhibit pivoting of the upper assembly, the handle 18 is lowered to a substantially horizontal position as shown in FIG. 4 where the element 132 engages the rearmost vertical slot portion 130. This locks the handle 18 into position with the gear case 14 and the cutter heads 68 and 70 being tilted upwardly where they may be readily worked on, such as sharpening or replacing cutter fingers 102. Additionally, the lock position of the handle 18 permits the entire machine to be lifted from the rear and transported by being wheeled across the floor shown in FIG. 5. To release the latch bar 122, the handle 18 is thereafter again lowered to the horizontal position which is followed by the latch bar 122 being manually lifted so that the outwardly projecting element 152 again falls into the horizontal slot portion 128. This now permits the handle 18 to be raised to its normal use position and a stripping operation can then be carried out.

Thus what has been shown and described is a relatively small, portable stripper machine which is particularly adapted for removing mastic or glue left over from carpets on wooden floors to facilitate the cleaning of the floor for refinishing prior to the application of additional or new carpeting.

Having thus shown and described what is at present considered to be the preferred embodiment of the invention, it should be noted that the same has been made by way of illustration and not limitation. Accordingly, all alterations, modifications and changes coming within the spirit and scope of the invention are herein meant to be included.

I claim:

1. A stripping machine for removing residual material from the surface of a floor, comprising:

a wheeled undercarriage for movement across the floor and including cutter height adjustment means located at the front thereof and cutter angle adjustment means located at the rear, said height adjustment means comprising a vertically adjustable support element and said cutter angle adjustment means comprising means projecting rearwardly from said carriage for selectively raising and lowering the back end of the undercarriage and accordingly the forward angle of attack of a cutter head;

an upper assembly pivotally mounted at the rear of the undercarriage and including forward projecting cutter head support means and motor mount means located behind said support means, said support means further having a front portion resting on said vertically adjustable support element of said cutter height adjustment means whereby the height of the cutter head above the floor can be controlled;

a handle secured to the upper assembly;

at least one said cutter head, including a plurality of downwardly projecting floor stripping cutter elements, rotatably mounted on said cutter head support means;

drive motor means for powering said at least one cutter head located on said motor mount means and including means for being connected in drive relationship with said cutter head; and a handle latch member having a forward end pivotally connected to said undercarriage and including an angulated slot in a rear portion thereof engaging an outwardly projecting member located on said motor mount means, whereby when said handle is lowered, said outwardly projecting member engages a rear portion of said angulated slot to prevent a further pivoting of the upper assembly on the undercarriage and the machine becomes a unitary assembly for transport or maintenance where said at least one cutter head is tilted in an upward direction.

2. The striping machine according to claim 1 wherein said wheeled undercarriage includes a set of wheels located on front side portions of said undercarriage.

3. The stripping machine according to claim 2 wherein said handle comprises an elongated handle extending from the rear of said wheeled undercarriage and said upper assembly.

4. The stripping machine according to claim 3 wherein said angulated slot comprises a relatively longer slot portion extending forwardly along a length dimension of said latch member and a relatively shorter slot portion extending upwardly along a width dimension of said latch member and wherein said outwardly projecting member on said motor mount means rides in said longer slot portion when said handle is normally elevated for a material removal operation and thereafter engages said shorter slot portion when said handle is manually lowered and the machine assumes said unitary position.

5. The stripping machine according to claim 4 wherein said slot portions in said handle latch member are substantially mutually orthogonal.

6. The stripping machine according to claim 1 wherein said cutter angle adjustment means includes a rearwardly projecting wheel carriage and a height adjustable wheel member mounted on said wheel carriage.

7. The stripping machine according to claim 6 wherein said wheel member comprises a caster type wheel.

8. The stripping machine according to claim 1 wherein said vertically adjustable support element of said cutter height adjustment means comprises a manually adjustably threaded member fitted to a threaded receiving member on said undercarriage.

9. The stripping machine according to claim 1 wherein said at least one cutter head comprises a pair of cutter heads.

10. The stripping machine according to claim 9 wherein said cutter head support means additionally comprises a gear housing and additionally including gear means in said gear housing coupled to said drive motor means for rotating said pair of cutter heads.

11. The stripping machine according to claim 10 wherein said gear means comprises a pair of meshed gears and said drive motor means is coupled to one of said gears for counter rotating said cutter heads.

12. The stripping machine according to claim 10 and additionally including a top cover attached to said gear housing.

13. The stripping machine according to claim 10 and additionally including a front skirt attached to said gear housing and depending down in front of said cutter heads.

14. The stripping machine according to claim 1 wherein said cutter head includes a plurality of peripheral faces and said cutter elements comprise a set of cutter fingers located on said peripheral faces.

15. The stripping machine according to claim 14 wherein said cutter fingers are fixedly attached to said peripheral faces.

16. The stripping machine according to claim 1 wherein said motor mount means comprises a bracket including a front wall member attached to a rear side of said cutter head support.

17. The stripping machine according to claim 16 wherein said motor mount bracket includes at least one side wall member including said outwardly projecting member engaging said latch member secured thereto.

18. The stripping machine according to claim 16 wherein said motor mount bracket includes a pair of side wall members extending rearwardly from said front wall member.

19. The stripping machine according to claim 18 and additionally including pivot means extending between said side wall members and secured to said undercarriage for joining said upper assembly to said undercarriage.

20. The stripping machine according to claim 19 wherein said pivot means comprises an elongated rod type axle member.

21. A stripping machine for removing residual material from the surface of a floor, comprising:

a wheeled undercarriage for movement across the floor and including cutter height adjustment means located at the front thereof and cutter angle adjustment means located at the rear, said height adjustment means comprising a vertically adjustable support element and said cutter angle adjustment means comprising means projecting rearwardly from said carriage for selectively raising and lowering the back end of the undercarriage and accordingly the forward angle of attack of a cutter head;

an upper assembly pivotally mounted at the rear of the undercarriage and including forward projecting cutter head support means and motor mount means located behind said support means, said support means further having a front portion resting on said vertically adjustable support element of said cutter height adjustment means whereby the height of the cutter head above the floor can be controlled;

a handle secured to the upper assembly; and at least one said cutter head, including a plurality of downwardly projecting floor stripping cutter elements, rotatably mounted on said cutter head support means; and drive motor means for powering said at least one cutter head located on said motor mount means and including means for being connected in drive relationship with said cutter head.

22. A stripping machine for removing residual material from the surface of a floor, comprising:

a wheeled undercarriage for movement across the floor;

an upper assembly pivotally mounted at the rear of the undercarriage and including forward projecting cutter head support means and motor mount means located behind said support means;

a handle secured to the upper assembly;

at least one said cutter head, including a plurality of downwardly projecting floor stripping cutter elements, rotatably mounted on said cutter head support means;

drive motor means for powering said at least one cutter head located on said motor mount means and including means for being connected in drive relationship with said cutter head; and a handle latch member having a forward end pivotally connected to said undercarriage and including an angulated slot in a rear portion thereof engaging an outwardly projecting member located on said motor mount means, whereby when said handle is lowered, said outwardly projecting member engages a rear portion of said angulated slot to prevent a further pivoting of the upper assembly on the undercarriage and the machine becomes a unitary assembly for transport or maintenance where said at least one cutter head is tilted in an upward direction.

* * * * *